US011772379B2

(12) United States Patent
Kozai et al.

(10) Patent No.: US 11,772,379 B2
(45) Date of Patent: Oct. 3, 2023

(54) INKJET HEAD, INKJET IMAGE FORMING APPARATUS, NOZZLE PLATE MANUFACTURING METHOD, AND INKJET HEAD MANUFACTURING METHOD

(71) Applicant: Konica Minolta, Inc., Tokyo (JP)

(72) Inventors: Hiroaki Kozai, Kodaira (JP); Yohei Sato, Hachioji (JP); Yusuke Hayashi, Hino (JP)

(73) Assignee: Konica Minolta, Inc., Tokyo (JP)

( * ) Notice: Subject to any disclaimer, the term of this patent is extended or adjusted under 35 U.S.C. 154(b) by 102 days.

(21) Appl. No.: 17/423,012

(22) PCT Filed: Feb. 20, 2019

(86) PCT No.: PCT/JP2019/006248
§ 371 (c)(1),
(2) Date: Jul. 14, 2021

(87) PCT Pub. No.: WO2020/170351
PCT Pub. Date: Aug. 27, 2020

(65) Prior Publication Data
US 2022/0097377 A1 Mar. 31, 2022

(51) Int. Cl.
*B41J 2/16* (2006.01)
*B41J 2/14* (2006.01)
*B41J 2/165* (2006.01)

(52) U.S. Cl.
CPC ..... *B41J 2/1626* (2013.01); *B41J 2/14024* (2013.01); *B41J 2/1632* (2013.01); *B41J 2/165* (2013.01)

(58) Field of Classification Search
CPC .... B41J 2/1626; B41J 2/14024; B41J 2/1632; B41J 2/165; B41J 2/1433; B41J 2/1606; B41J 2/162; B41J 2/1628; B41J 2/1629; B41J 2/1631; B41J 2002/14241; B41J 2002/14403; B41J 2/14233; B41J 2/16538; B41J 2002/14411; B41J 2002/14491; B41J 2002/16502; B41J 2202/12
See application file for complete search history.

(56) References Cited

FOREIGN PATENT DOCUMENTS

| | | |
|---|---|---|
| JP | 2000-326514 A | 11/2000 |
| JP | 2007-276256 A | 10/2007 |
| JP | 2009-113351 A | 5/2009 |

(Continued)

OTHER PUBLICATIONS

Machine Translation of WO 2018186159 "Liquid Discharge Device", Seike et al., Nov. 10, 2018, pp. 7-11 (Year: 2018).*

(Continued)

*Primary Examiner* — Lisa Solomon
(74) *Attorney, Agent, or Firm* — Rankin, Hill & Clark LLP

(57) ABSTRACT

There are provided an inkjet head, an inkjet image forming apparatus, a nozzle plate manufacturing method, and an inkjet head manufacturing method capable of improving durability against wiping on an ink discharge surface. The inkjet head includes a nozzle substrate including nozzle holes from which ink is discharged. The nozzle substrate has an irregularity structure formed on an ink discharge surface such that neither ink particles contained in the ink nor a wiping member that wipes the ink discharge surface get caught by the irregularity structure.

20 Claims, 11 Drawing Sheets

(56) References Cited

FOREIGN PATENT DOCUMENTS

| | | | |
|---|---|---|---|
| JP | 2012-101365 | A | 5/2012 |
| JP | 5520193 | B2 | 6/2014 |
| WO | 2018/186159 | A1 | 10/2018 |

OTHER PUBLICATIONS

IP.com search (Year: 2023).*
International Search Report (ISR) dated May 7, 2019 filed in PCT/JP2019/006248.
PCT Written Opinion of the International Searching Authority dated May 7, 2019 filed in PCT/JP2019/006248.

* cited by examiner

FIG. 8

| | EXAMPLE | COMPARATIVE EXAMPLE 1 | COMPARATIVE EXAMPLE 2 |
|---|---|---|---|
| MAGNITUDE RELATIONSHIP BETWEEN W AND p | W > p | W > p | W < p |
| MAGNITUDE RELATIONSHIP BETWEEN r AND d | r < d | r > d | ARBITRARY |
| LIQUID REPELLENCY | ○ | × | × |

INKJET HEAD, INKJET IMAGE FORMING APPARATUS, NOZZLE PLATE MANUFACTURING METHOD, AND INKJET HEAD MANUFACTURING METHOD

TECHNICAL FIELD

The present invention relates to an inkjet head, an inkjet image forming apparatus, a nozzle plate manufacturing method, and an inject head manufacturing method.

BACKGROUND ART

In an inkjet printer, when an atomized ink (ink mist) adheres to a nozzle surface on which the ink is discharged from a nozzle of an inkjet head (hereinafter, also referred to as an ink discharge surface), a solidified ink blocks an opening of the nozzle. Thus, bending of ink ejection is caused, and an image defect is eventually caused.

In the related art, a technique of forming a water-repellent film layer on the ink discharge surface to improve water repellency of the ink on the ink discharge surface and wiping off the ink with a wiping member including a material such as rubber or cloth is used for this problem. However, in such a technique of the related art, the water-repellent film layer is worn as the number of times of wiping increases and, thus, there is a problem that the water repellency of the ink discharge surface deteriorates. Thus, a technique for improving the durability against the wiping on the ink discharge surface is required, and there are techniques described in, for example, the following Patent Literatures 1 and 2 as a technique for coping with such a problem.

CITATION LIST

Patent Literature

Patent Literature 1: JP 2009-113351 A
Patent Literature 2: JP 5520193 B

SUMMARY OF INVENTION

Technical Problem

The technique described in Patent Literature 1 is provided, in which a protective film having protrusions and recesses is provided on the ink discharge surface and the water-repellent film is formed along the protrusions and recesses of the protective film. However, in the technique described in Patent Literature 1, parameters of the protrusions and recesses of the protective film are values for providing a water-repellent structure, and a special technique and labor are required for forming the protrusions and recesses.

In the technique described in Patent Literature 2, mechanical strength is further improved as compared to the irregularity structure described in Patent Literature 1 by providing a fluorine-containing DLC film having the irregularity structure formed on the ink discharge surface. However, in the technique described in Patent Literature 2, a special technique and labor are required for forming the protrusions and recesses.

An object of the present invention is to provide an inkjet head, an inkjet image forming apparatus, a nozzle plate manufacturing method, and an inkjet head manufacturing method capable of improving durability against wiping on an ink discharge surface.

Solution to Problem

An inkjet head according to the present invention is an inkjet head that includes a nozzle substrate including a nozzle hole from which ink is discharged. The nozzle substrate has an irregularity structure formed on an ink discharge surface such that neither ink particles contained in the ink nor a wiping member that wipes the ink discharge surface get caught by the irregularity structure.

An inkjet image forming apparatus according to the present invention includes the above inkjet head.

A nozzle plate manufacturing method according to the present invention is a method for manufacturing a nozzle plate which is used in an inkjet head and in which the nozzle plate has nozzle holes from which ink is discharged. The method includes forming, on an ink discharge surface in the nozzle plate, an irregularity structure in which neither ink particles contained in the ink nor a wiping member that wipes the ink discharge surface get caught by the irregularity structure.

An inkjet head manufacturing method according to the present invention includes a process of forming, on an ink discharge surface in a nozzle plate, an irregularity structure by which neither ink particles contained in the ink nor a wiping member that wipes the ink discharge surface does get caught, in which the nozzle plate has therein nozzle holes from which ink is discharged.

Advantageous Effects of Invention

According to the present invention, the durability against the wiping on the ink discharge surface can be improved.

BRIEF DESCRIPTION OF DRAWINGS

FIG. 8 is a table representing Example and Comparative Examples of the irregularity structure on the ink discharge surface in comparison.

DESCRIPTION OF EMBODIMENTS

Figure 1:
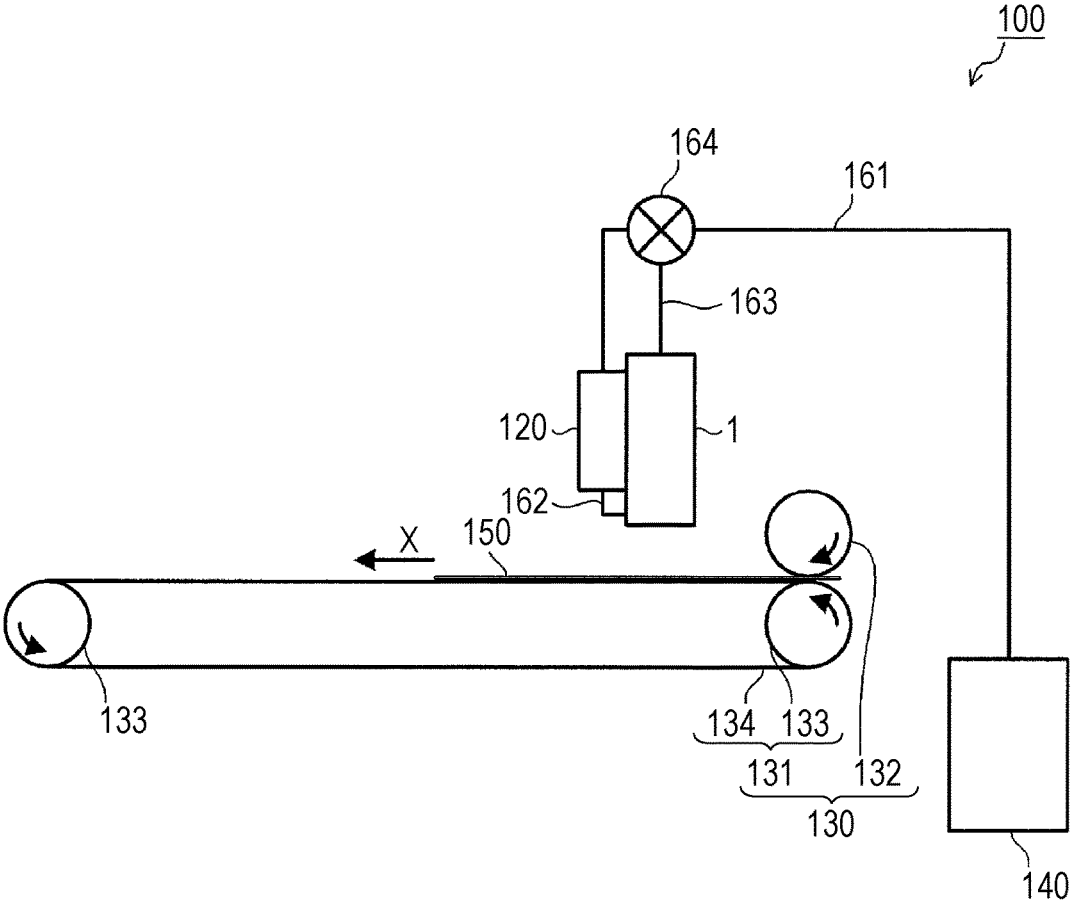
FIG. 1 is a diagram illustrating a configuration example of an inkjet image forming apparatus according to the present embodiment.

Hereinafter, the present embodiment will be described in detail with reference to the drawings. In the drawings, common members are denoted by the same reference signs. The present invention is not limited to the following embodiment.

An inkjet image forming apparatus according to the present embodiment can have a configuration similar to a known inkjet image forming apparatus, such as an inkjet image forming apparatus described in JP 2002-273867 A, except that, for example, the inkjet image forming apparatus includes an inkjet head according to the present embodiment to be described later. Hereinafter, a more detailed description will be given with reference to the drawings.

As illustrated in FIG. 1, an inkjet image forming apparatus 100 includes an inkjet head 1, an ink supply device 120, a conveyance device 130, and a main tank 140.

The inkjet head 1 has a plurality of nozzles for discharging ink droplets onto a recording medium 150, such as a paper sheet, as a printing target. For example, the inkjet head 1 is configured such that a plurality of kinds of inks having different colors is supplied to specific nozzles. For example, the inkjet head 1 is disposed to be scannable in a direction crossing a conveyance direction X of the recording medium 150 on which an image is to be formed. A configuration of the inkjet head 1 will be described later.

The conveyance device 130 is a device for conveying the recording medium 150 to the inkjet head 1. The conveyance device 130 includes, for example, a belt conveyor 131 and a rotatable feed roller 132. The belt conveyor 131 includes rotatable pulleys 133 and 133, and an endless belt 134 stretched over the pulleys 133 and 133. The feed roller 132 is disposed at a position facing the pulley 133 on an upstream side in the conveyance direction X of the recording medium 150 so as to nip the belt 134 and the recording medium 150 and feed the recording medium 150 onto the belt 134.

The ink supply device 120 is disposed integrally with the inkjet head 1. The ink supply device 120 is disposed for each kind of ink. For example, in a case where inks of four colors of yellow (Y), magenta (M), cyan (C), and black (K) are used, four ink supply devices 120 are arranged in the inkjet head 1.

The ink in the main tank 140 is supplied to each ink supply device 120 via a tube 161 and a valve 164 connected to the main tank 140. Each ink supply device 120 is communicatively connected with a common ink chamber 2 to be described later of the inkjet head 1 via a tube 162, and is connected to be able to supply the ink of each color to a desired supply port 2*a* of the common ink chamber 2.

The inkjet head 1 is also connected to the main tank 140 by a bypass tube 163 branching from the tube 161. At a branch point between the tube 161 and the bypass tube 163, the valve 164 capable of switching and setting a flow path of ink is disposed at one or both of the tubes 161 and 163. Each of the tubes 161 and 162 and the bypass tube 163 is, for example, a tube having flexibility. The valve 164 is, for example, a three-way valve.

The main tank 140 is a tank for storing ink to be supplied to the inkjet head 1. The main tank 140 is disposed separately from the inkjet head 1. The main tank 140 includes, for example, a stirring device (not illustrated). The main tank 140 can be appropriately decided according to image forming performance, size, and the like of the inkjet image forming apparatus 100. For example, when an image forming speed of the inkjet image forming apparatus is 1 to 3 $m^2$/min, the capacity of the main tank 140 is, for example, 1 L.

In the inkjet image forming apparatus 100, a wiping member (not illustrated in FIG. 1.) for wiping and removing ink adhered to an ink discharge surface (in FIG. 1, a lower surface of the inkjet head 1) including a discharge port to be described later of the inkjet head 1 is used. For example, rubber, cloth, or the like is used as a material of the wiping member.

The inkjet image forming apparatus 100 may be configured such that the wiping member can be connected and disconnected from the ink discharge surface of the inkjet head 1 by an actuator (not illustrated) or the like, and the ink discharge surface is automatically cleaned by operating the wiping member according to an ink discharge amount or the like. Alternatively, a user may manually clean the ink discharge surface by moving the wiping member.

Figure 2:
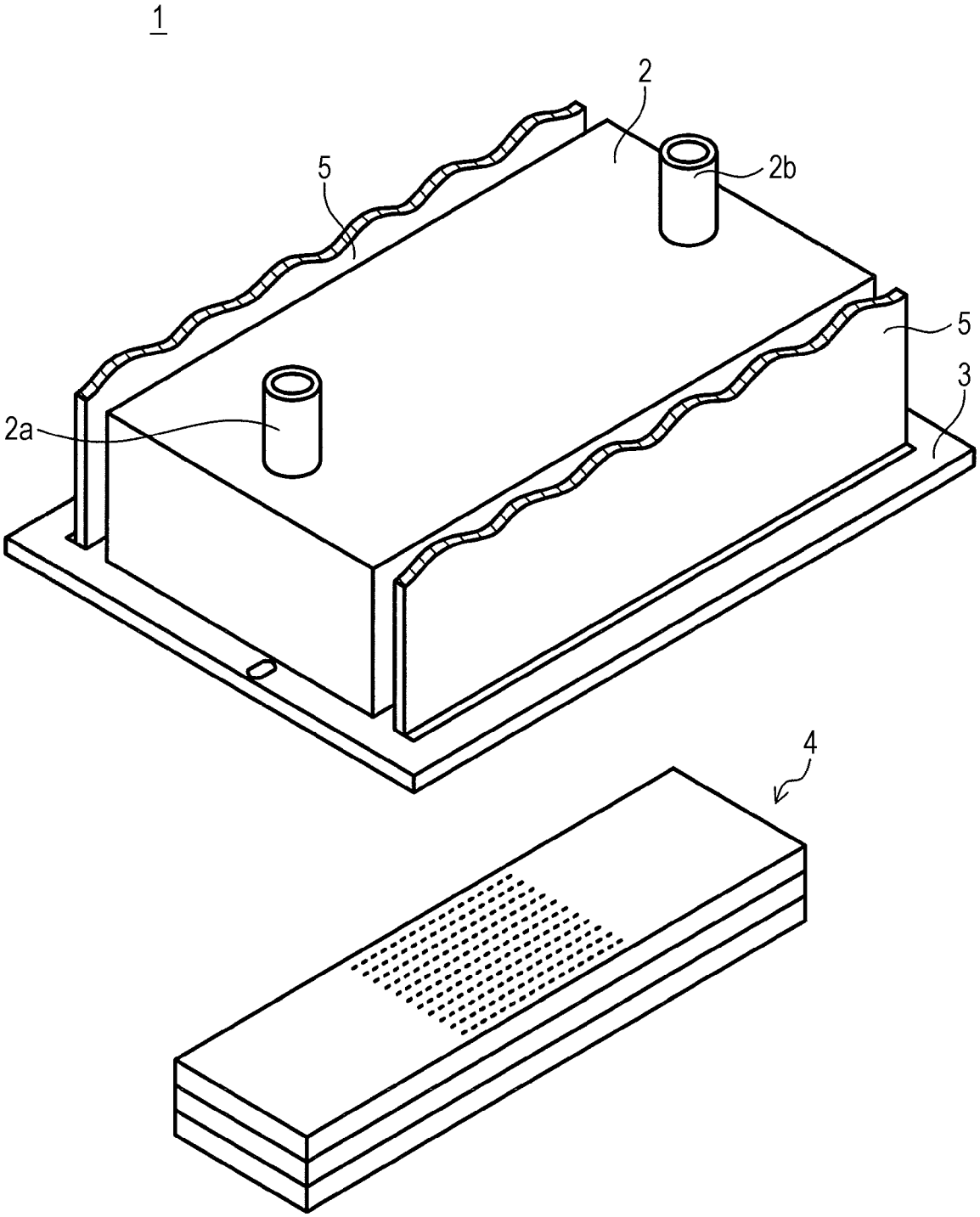
FIG. 2 is a schematic configuration diagram illustrating an example of an inkjet head according to the present embodiment.

Next, the configuration of the inkjet head 1 will be described with reference to FIGS. 2 and 3. FIG. 2 is a schematic configuration diagram of the inkjet head, and FIG. 3 is a cross-sectional view of the inkjet head.

Figure 3:
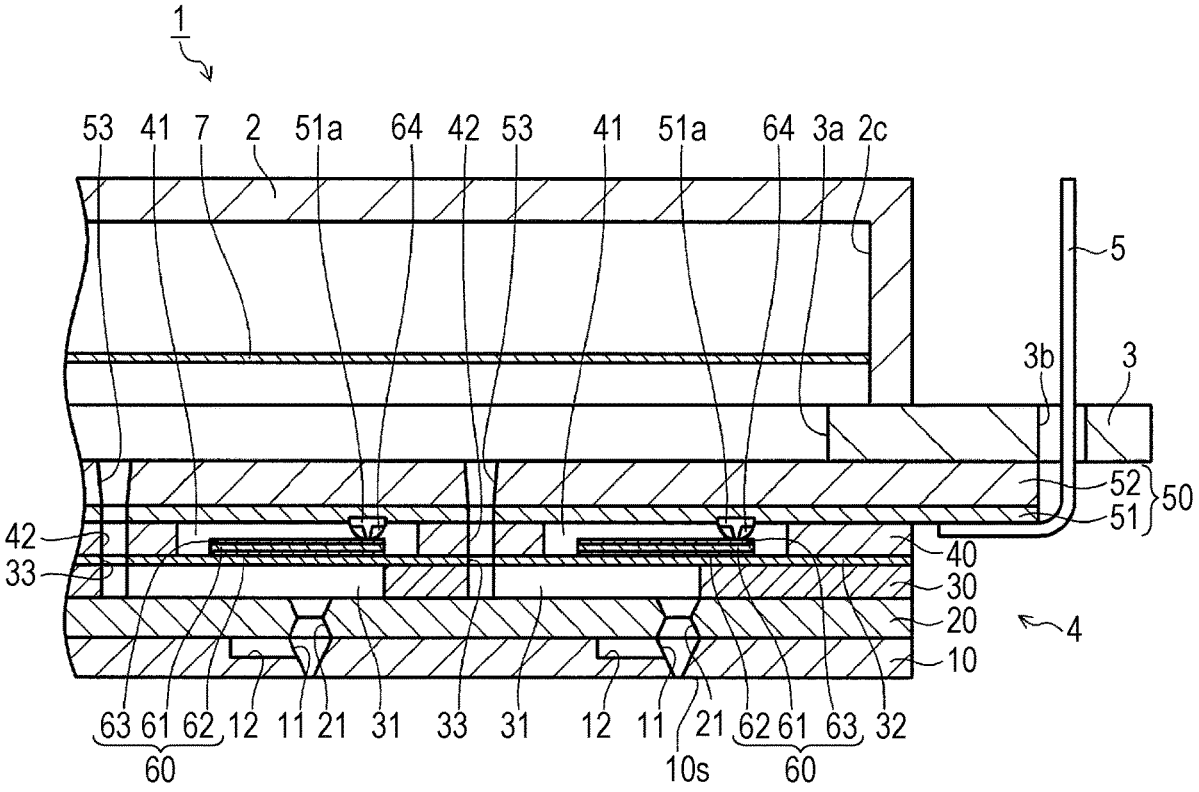
FIG. 3 is a cross-sectional view of an inkjet head according to the present embodiment.

The apparatus illustrated in FIGS. 2 and 3 is a perspective view illustrating an outline of the inkjet head 1 used in the above-described inkjet image forming apparatus 100. As illustrated in FIG. 2, the inkjet head 1 includes the common ink chamber 2, a holding unit 3, a head chip 4, and a flexible wiring board 5.

The common ink chamber 2 is formed in a hollow substantially rectangular cuboid shape, and one surface is opened. The ink supply port 2*a* for supplying the ink of the ink supply device 120 and an ink discharge port 2*b* for discharging the ink to the ink supply device 120 are provided on one surface opposite to the opening of the common ink chamber 2.

As illustrated in FIG. 3, a filter 7 is provided in an interior 2*c* of the common ink chamber 2. The filter 7 is formed by using a mesh-like member. The filter 7 removes foreign substances from the ink supplied from the ink supply port 2*a* and finely crushes air bubbles contained in the ink. The holding unit 3 is disposed so as to cover the opening of the common ink chamber 2.

The holding unit 3 is formed in a substantially flat plate shape having an opening 3*a* in a substantially center. The common ink chamber 2 is connected to one surface of the holding unit 3 so as to cover the opening 3*a*. The head chip 4 is connected to the other surface of the holding unit 3 so as to cover the opening 3*a*. The common ink chamber 2 and the head chip 4 are communicatively connected with each other via the opening 3*a* of the holding unit 3.

An insertion hole 3*b* is provided in an outer peripheral portion of the holding unit 3. The flexible wiring board 5 is inserted into the insertion hole 3*b*. The flexible wiring board 5 is connected to a wiring board 50 of the head chip 4 to be described later. The flexible wiring board 5 is inserted through the insertion hole 3*b* provided in the holding unit 3 from the other surface of the holding unit 3 and is drawn out toward the common ink chamber 2.

The head chip 4 includes a nozzle plate 10, an intermediate plate 20, a pressure chamber forming plate 30, a drive plate 40, and the wiring board 50. In the head chip 4, the nozzle plate 10, the intermediate plate 20, the pressure chamber forming plate 30, the drive plate 40, and the wiring board 50 are stacked in this order from the discharge surface side of the ink.

A plurality of nozzle holes 11 and a flow path 12 are formed in the nozzle plate 10. The nozzle holes 11 penetrate from one surface to the other surface of the nozzle plate 10. The nozzle hole 11 has a cross-sectional shape narrowed down such that a distal end side serving as a discharge port has a small diameter, and discharges the ink supplied from the common ink chamber 2 to the outside from the discharge port. The plurality of (for example, 500 to 2000) nozzle holes 11 is provided in the nozzle plate 10, and is arranged in a matrix. The nozzle holes 11 are communicatively connected with pressure chambers 31 formed in the pressure chamber forming plate 30 via the intermediate plate 20 stacked on the nozzle plate 10.

In FIG. 3, a lower surface of the nozzle plate 10 is an ink discharge surface 10*s*. The ink discharge surface 10*s* of the nozzle plate 10 is wiped (rubbed) by the above-described wiping member, and thus, the adhered ink is wiped off and is cleaned. A water-repellent film layer (not illustrated) having water repellency is formed on the ink discharge surface 10*s* of the nozzle plate 10 in order to facilitate cleaning of the residual ink of the discharged ink.

Silicon, metal, or resin can be used as a material of the nozzle plate 10. In FIG. 3, the nozzle plate 10 is illustrated as a single layer for the sake of convenience in description. On the other hand, the nozzle plate 10 may include a plurality of layers obtained by combining plate materials of the above-described materials (different materials). Alternatively, the nozzle plate 10 may be formed by processing a substrate including a plurality of layers having an active layer and an oxide film layer, such as a silicon on insulator (SOI) substrate.

The flow path 12 is formed continuously with the nozzle holes 11. The flow path 12 is a recess recessed from one surface toward the other surface of the nozzle plate 10. The flow path 12 extends in a direction intersecting an axial direction of the nozzle hole 11. A flow path resistance of the ink passing through the nozzle plate 10 is reduced by the flow path 12.

The intermediate plate 20 is disposed between the nozzle plate 10 and the pressure chamber forming plate 30. First communication holes 21 that communicatively connect the nozzle holes 11 with the pressure chambers 31 provided in the pressure chamber forming plate 30 to be described later are provided in the intermediate plate 20. The first communication holes 21 are provided at positions corresponding to the nozzle holes 11 of the nozzle plate 10, and penetrate from one surface to the other surface of the intermediate plate 20.

The pressure chamber forming plate 30 includes a plurality of pressure chambers 31 and a vibrating plate 32. The pressure chambers 31 penetrate from one surface to the other surface of the pressure chamber forming plate 30. A discharge pressure is applied to the ink to be discharged from the nozzle hole 11 by the pressure chambers 31. The pressure chambers 31 are provided at positions corresponding to the nozzle holes 11 of the nozzle plate 10 and the first communication holes 21 of the intermediate plate 20.

The vibrating plate 32 is disposed so as to cover openings of the pressure chambers 31 opposite to the intermediate plate 20. Second communication holes 33 that are communicatively connected with the pressure chambers 31 are provided in the vibrating plate 32. The drive plate 40 is disposed on one surface of the vibrating plate 32 opposite to the one surface on the pressure chamber 31 side.

The drive plate 40 has spaces 41 and third communication holes 42 that are communicatively connected with the second communication holes 33. The spaces 41 are arranged at positions facing the pressure chambers 31 with the vibrating plate 32 interposed therebetween. An actuator 60 is accommodated in the space 41.

The actuator 60 includes a piezoelectric element 61, a first electrode 62, and a second electrode 63. The first electrode 62 is stacked on one surface of the vibrating plate 32. The piezoelectric element 61 is stacked on the first electrode 62, and is disposed at a position facing the pressure chamber 31 with the vibrating plate 32 and the first electrode 62 interposed therebetween. The piezoelectric element 61 is provided for each pressure chamber 31 (for each channel).

The piezoelectric element 61 is made of a material that is deformed due to an applied voltage, and is made of, for example, a ferroelectric material such as lead zirconate titanate (PZT). The second electrode 63 is stacked on a surface of the piezoelectric element 61 opposite to the first electrode 62. The second electrode 63 is connected to a wiring layer 51 provided on the wiring board 50 to be described later via bumps 64.

The wiring board 50 includes the wiring layer 51 and a silicon layer 52 in which the wiring layer 51 is formed on one surface. The wiring layer 51 is connected to the bumps 64 provided on second electrode 63 via solders 51*a*. An outer edge of the wiring layer 51 is connected to the flexible wiring board 5. The silicon layer 52 is disposed on one surface of the wiring layer 51 opposite to the drive plate 40. The silicon layer 52 is bonded to the holding unit 3.

Fourth communication holes 53 that penetrate the wiring layer 51 and the silicon layer 52 are provided in the wiring board 50. The fourth communication holes 53 are communicatively connected with the common ink chamber 2 through the third communication holes 42 of the drive plate 40 and the opening 3*a* of the holding unit 3.

In the inkjet head 1, an inlet serving as a flow path for supplying the ink in the common ink chamber 2 to the pressure chamber 31 is constituted by the fourth communication holes 53 of the wiring board 50, the third communication holes 42 of the drive plate 40, and the second communication holes 33 of the vibrating plate 32 that are communicatively connected with each other. The inlet plays a role of reducing the flow path resistance (flow rate) of the ink flowing into the pressure chambers 31 from the common ink chamber 2. An outlet for discharging the ink in the pressure chamber 31 toward the recording medium 150 is constituted by the first communication holes 21 of the intermediate plate 20 and the nozzle holes 11 of the nozzle plate 10 that are communicatively connected with each other.

In the inkjet head 1 having such a configuration, the ink stored in the common ink chamber 2 passes through the inlet (That is, the fourth communication holes 53, the third communication holes 42, and the second communication holes 33) and flows into the pressure chamber 31. A voltage is applied to the first electrode 62 and the second electrode 63, and thus, the piezoelectric element 61 is deformed, and the vibrating plate 32 is deformed along with the deformation of the piezoelectric element 61. The vibrating plate 32 is deformed, and thus, a pressure for discharging the ink is generated in the pressure chamber 31. Due to the generation of such pressure, the ink in the pressure chamber 31 is pushed out to the outlet (that is, the first communication holes 21 and the nozzle holes 11), and is discharged from the distal end of the nozzle hole 11 (nozzle opening) toward the recording medium 150.

Incidentally, in the inkjet head 1, when an atomized ink (ink mist) adheres to the ink discharge surface 10*s* which is the surface of the nozzle plate 10 on which the ink is discharged, solidified ink blocks the distal end side of the nozzle hole 11. Thus, bending of ink ejection is caused, and an image defect is eventually caused.

In the related art, a technique of wiping off the ink discharge surface 10*s* of the nozzle plate 10 with the wiping member made of rubber, cloth, or the like has been used to deal with this problem. On the other hand, in such a technique, the water-repellent film layer is worn as the number of times of wiping increases and, thus, there is a problem that the water repellency of the ink discharge surface 10*s* deteriorates. Thus, a technique for improving the durability against the wiping on the ink discharge surface 10*s* of the nozzle plate 10 is required.

In the inkjet head 1, when the ink discharge surface 10*s* of the nozzle plate 10 on which the ink containing carbon black particles remains is wiped by the wiping member in the same manner as other pigment inks, there is a problem that the water-repellent film layer is easily damaged by the carbon black particles. In other words, when the ink discharge surface 10*s* to which the ink containing the carbon black particles adheres is cleaned by the wiping member, there is a problem that the water-repellent film layer deteriorates (e.g. is worn) even with a relatively small number of times of wiping and the water repellency of the ink discharge surface 10*s* deteriorates. In the irregularity structures described in Patent Literatures 1 and 2 described above, the effect when the ink discharge surface to which the ink containing the carbon black particles adheres is wiped by the wiping member is not described, and in such a case, the water-repellent film layer is likely to be damaged.

Accordingly, in the present embodiment, an irregularity structure in which the carbon black particles contained in the ink get caught and the wiping member for wiping the ink discharge surface 10*s* does not get caught is provided on the ink discharge surface 10*s* of the nozzle plate 10. Hereinafter, such an irregularity structure will be described with reference to FIG. 4.

Figure 4:
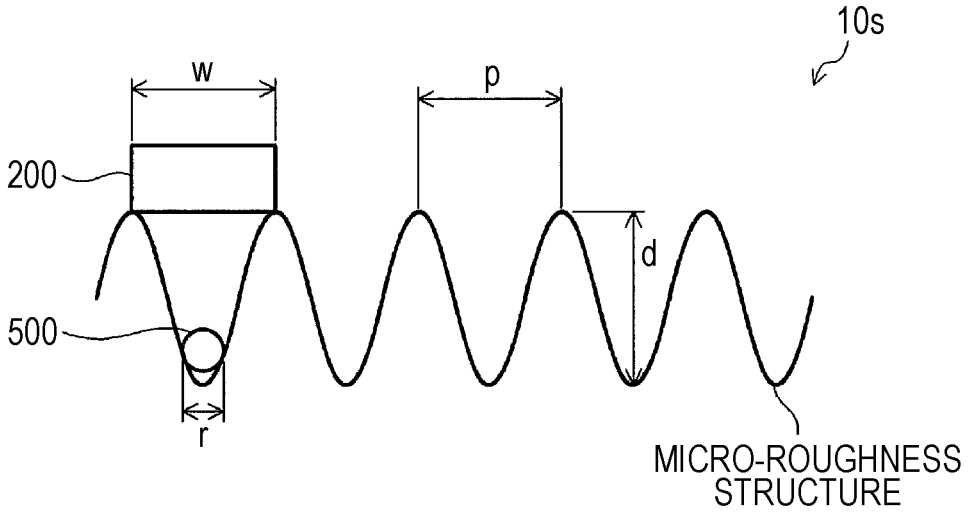
FIG. 4 is a diagram for describing an outline of an irregularity structure formed on an ink discharge surface of the inkjet head according to the present embodiment.

FIG. 4 is a schematic enlarged cross-sectional view illustrating a part of the ink discharge surface 10*s* of the nozzle plate 10, and illustrates the ink discharge surface 10*s* as an upper side unlike FIG. 3. In FIG. 4, it is assumed that a wiping member made of cloth in which a plurality of fibers is woven is used, and one fiber constituting such a wiping member (cloth) is denoted by a reference sign 200.

Although not illustrated in FIG. 4, a water-repellent film is provided on a front surface (upper irregularity surface in FIG. 4) of the ink discharge surface 10*s* of the nozzle plate 10 in the present embodiment. A water-repellent base layer is interposed between the water-repellent film and the ink discharge surface 10*s*.

The water-repellent base layer improves adhesion to the water-repellent film and ink resistance, and for example, an oxide of silicon carbide, titanium, aluminum, zirconium, chromium, hafnium, nickel, tantalum, or silicon, a nitride thereof, or the like can be used as an ink-resistant protective film material. As the configuration of the oxide or nitride, a configuration containing only one element of the above-described various elements, or a configuration containing two or more elements in order to improve durability may be used. Examples of the configuration containing two or more elements include hafnium silicate containing hafnia and silicon, tantalum silicate containing tantalum and silicon, and the like.

In the present embodiment, the above-described water-repellent base layer is provided on the ink discharge surface 10*s*, and a monomolecular water-repellent film that forms a siloxane bond with the water-repellent base layer is provided on the water-repellent base layer. As described above, the base layer of the water-repellent film and the water-repellent film are chemically bonded, and thus, the water-repellent film is firmly supported on the base layer. Such a water-repellent film is provided on the front surface of the ink discharge surface 10*s*, and thus, the ink adhesion to the ink discharge surface 10*s* is suppressed.

As illustrated in FIG. 4, the ink discharge surface 10*s* of the nozzle plate 10 in the present embodiment has a depth to the extent that carbon black particles 500 can be caught. Here, the carbon black particles 500 include a plurality of aggregated primary particles of carbon black. For the sake of simplification, although FIG. 4 illustrates that the carbon black particles 500 are in spherical shapes, actual outer shapes of the carbon black particles 500 are non-spherical and have different particle sizes. On the other hand, as a result of statistical calculation by the present inventors, it can be seen that a median value of particle sizes (diameters) of the carbon black particles 500 was about 110 nm.

In FIG. 4, a height of a protrusion and a recess in the irregularity structure (micro-roughness structure) of the ink discharge surface 10*s* is denoted by a reference sign d, a width of the protrusion and the recess (pitch between the protrusions) is denoted by a reference sign p, and a width of the wiping member (in this example, a thickness or diameter of the fiber 200) is denoted by a reference sign W.

For the sake of simplicity, FIG. 4 illustrates that cross-sectional shapes of individual protrusions and recesses of the ink discharge surface 10*s* are uniform (that is, the vertexes of the protrusions are flush with each other) and are sinusoidal. On the other hand, although the cross-sectional shapes depend on the forming method, the cross-sectional shapes of the individual protrusions and recesses, and eventually, the height d of the protrusion and recess and the width p of the protrusion and recess may be actually non-uniform. The thicknesses or diameters W of the fibers 200 constituting the wiping member may be actually non-uniform.

In consideration of the above dimensions, parameters related to the irregularity structure on the ink discharge surface 10*s* of the nozzle plate 10 and the dimension of the wiping member are set to satisfy the following Expressions 1 and 2:

$$W \geq p \geq r \quad \text{(Expression 1)}$$

$$d \geq r \quad \text{(Expression 2)}$$

In the above Expressions 1 and 2, the values of p, d, r, and W may be statistical values (statistics). Specifically, the value of p may be a statistic of the width of the recess in the irregularity structure, that is, a median value or an average value of a dimensional distribution. The value of d may be a median value or an average value of heights of the protrusions and the recesses in the irregularity structure. The value of r may be a median value or an average value of the particle sizes (diameters) of the carbon black particles 500. The value of W may be a median value or an average value of the dimensional distribution of the diameters of the individual fibers 200 constituting the wiping member.

The example of the irregularity structure of the ink discharge surface 10*s* illustrated in FIG. 4 is an example satisfying the above Expressions 1 and 2. According to such an irregularity structure, after the ink is discharged from the nozzle hole 11, since the carbon black particles 500 have a specific gravity higher than a specific gravity of a liquid constituting the ink, the carbon black particles are accumulated in the recesses (bottom side) of the ink discharge surface 10*s* as illustrated in FIG. 4.

Since the diameter W of the fiber 200 constituting the wiping member is larger than the pitch p between the protrusions of the irregularity structure of the ink discharge surface 10*s*, the fibers 200 move on the protrusions of the ink discharge surface 10*s* and do not reach the recesses as illustrated in FIG. 4.

Accordingly, when the ink discharge surface 10*s* of the nozzle plate 10 is wiped by the wiping member, the wiping member (fibers 200) and the carbon black particles 500 remaining on the ink discharge surface 10*s* are prevented from coming into direct contact with each other.

Thus, at the time of cleaning the ink discharge surface 10*s*, only the water-repellent film in the region of the protrusion in the water-repellent film formed in the irregularity structure of the ink discharge surface 10*s* is rubbed by the wiping member. At this time, the ink liquid containing the carbon black particles 500 accumulated on the recess side of the ink discharge surface 10*s* permeates the fibers 200 and is cleaned by the wiping member.

As described above, the water-repellent film formed in the region of the recess of the ink discharge surface 10*s* is a non-contact region where the wiping member does not come into direct contact with the water-repellent film. As a result, the deterioration (abrasion or the like) of the film due to the movement of the carbon black particles 500 pressed by the wiping member (fibers 200) can be suppressed.

In general, according to the irregularity structure of the ink discharge surface 10*s* in the present embodiment, the durability of the water-repellent film formed in the region of the recess of the ink discharge surface 10*s* is enhanced, and the water repellency of the entire ink discharge surface 10*s* can be maintained. Accordingly, the durability against the wiping on the ink discharge surface 10*s* can be improved.

An example of an irregularity structure as a comparative example when the above Expression 1 or 2 is not satisfied will be described with reference to FIGS. 5A and 5B.

Figure 5A:
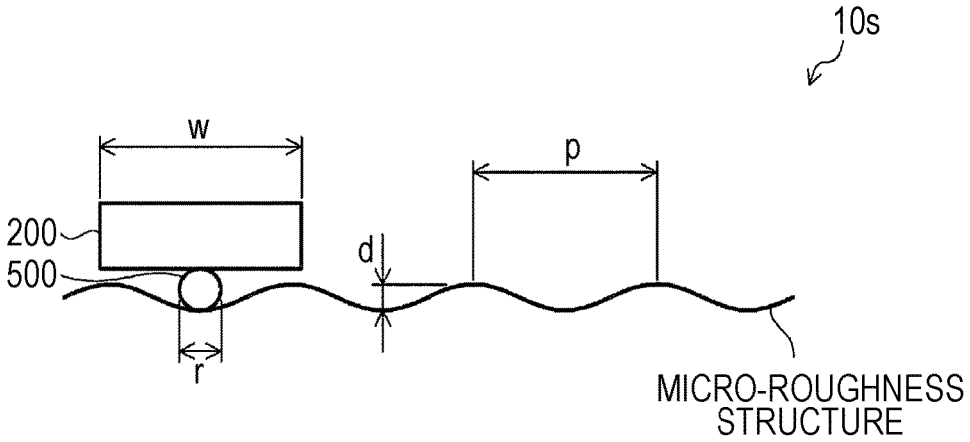
FIGS. 5A and 5B are diagrams for describing Comparative Example 1 and Comparative Example 2 of the irregularity structure formed on the ink discharge surface, respectively.

An example illustrated in FIG. 5A is a case where the height d of the protrusion and recess in the irregularity structure of the ink discharge surface 10*s* is too small, and it can be seen that an upper portion of the carbon black particles 500 remaining in the recess of the irregularity structure is positioned above the protrusion of the irregularity structure. In the case of such an irregularity structure, when the ink discharge surface 10*s* is wiped by the wiping member, an operation of wiping the ink while pressing the carbon black particles 500 by the fibers 200 is performed. With such an operation, the water-repellent film formed on the ink discharge surface 10*s* is scraped by the carbon black particles 500, and the durability of the water-repellent film cannot be maintained.

Figure 5B:
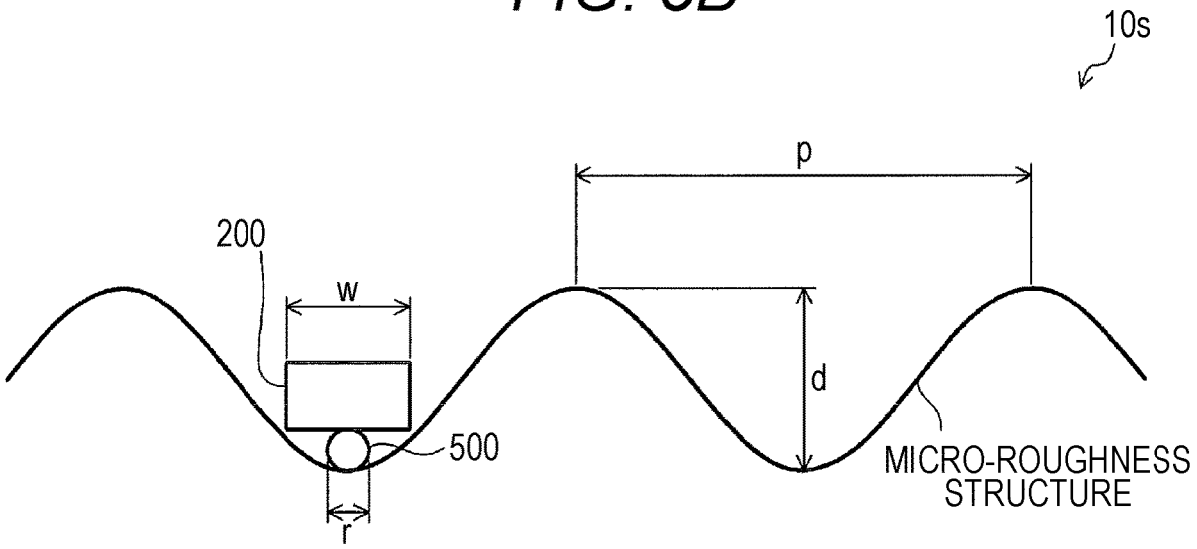

An example illustrated in FIG. 5B is a case where the width p of the recess (pitch between the protrusions) in the irregularity structure of the ink discharge surface 10*s* is too wide, and it can be seen that the fibers 200 of the wiping member are caught at the position close to a bottom surface of the recess. Even in the case of such an irregularity structure, when the ink discharge surface 10*s* is wiped by the wiping member, the operation of wiping the ink while pressing the carbon black particles 500 by the fibers 200 is performed. According to such an operation, the water-repellent film (mainly the water-repellent film in the region of the recess) formed on the ink discharge surface 10*s* is scraped by the carbon black particles 500, and the durability of the water-repellent film cannot be maintained.

Accordingly, in the present embodiment, the values of the depth d and the width (pitch) p in the irregularity structure are designed so as to satisfy Expressions 1 and 2 described above, and the nozzle plate 10 is produced.

The irregularity shape of the entire region of the ink discharge surface 10*s* of the nozzle plate 10 does not need to satisfy the above Expressions 1 and 2. For example, a portion of the ink discharge surface 10*s* away from the nozzle hole 11 to some extent may not satisfy the above Expressions 1 and 2. On the other hand, in the region close to the nozzle hole 11, that is, a peripheral portion surrounding the nozzle hole 11 in the ink discharge surface 10*s*, it is desirable that the number of irregularity-shaped portions satisfying the above Expressions 1 and 2 is as large as possible (ideally, all the protrusions and recesses of such a peripheral portion satisfy the above Expressions 1 and 2).

The irregularity structure that satisfies Expressions 1 and 2 described above can be produced by various methods. Hereinafter, a case where the above-described irregularity structure is formed on the ink discharge surface 10*s* of the nozzle plate 10 by using a blasting method will be described.

Figure 6:
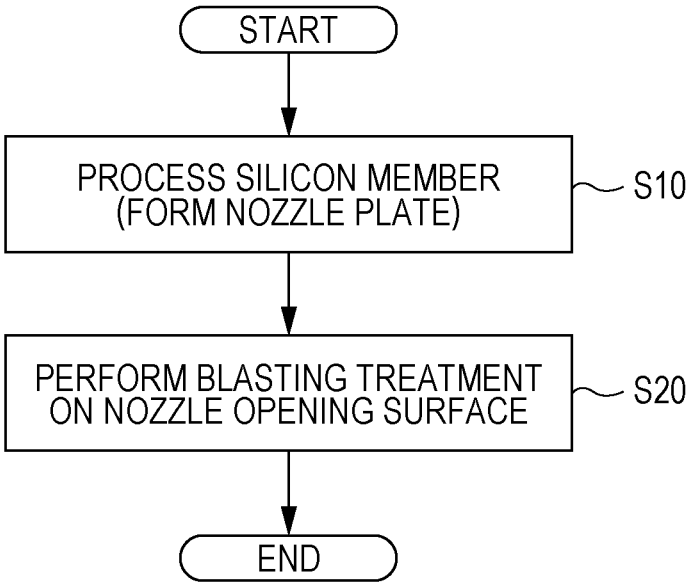
FIG. 6 is a diagram for describing a method for forming the irregularity structure on the ink discharge surface.

FIG. 6 illustrates a first method of the method for forming the irregularity structure of the ink discharge surface 10*s* in the present embodiment. In the first method, a silicon member is processed so as to form the nozzle holes 11 and the flow paths 12 described above in FIG. 3, and thus, the nozzle plate 10 is produced (step S10). Subsequently, the above-described irregularity structure is formed by performing a blasting treatment on the nozzle opening surface (that is, the ink discharge surface 10*s*) (step S20). Here, a known blasting treatment can be used as the blasting treatment. According to the first method, the irregularity structure can be formed at low cost.

(Example and the Like)

The present inventors experimentally manufactured the nozzle plate 10 as Example and Comparative Examples of the above-described irregularity structure by using the first method. The above-described water-repellent base layer and monomolecular water-repellent film that forms the siloxane bond with the water-repellent base layer were formed on the ink discharge surface 10*s* of each prototype (nozzle plate 10), and an experiment (hereinafter, referred to as a liquid repellency deterioration experiment) as to whether or not the liquid repellency deteriorated by wiping (rubbing) the ink discharge surface 10*s* was performed. In the liquid repellency deterioration experiment, the ink containing the carbon black particles was caused to adhere to the ink discharge surface 10*s* of each prototype on which the above-described water-repellent base layer and monomolecular water-repellent film were formed, the ink discharge surface 10*s* was rubbed by the wiping member, and whether or not the liquid repellency of the rubbed ink discharge surface 10*s* deteriorated was examined.

As common conditions in Example and Comparative Examples, ASPURE WIPER (made of polyester) manufactured by AS ONE Corporation was used as the wiping member. When the diameter (thickness) W of the fiber of the wiping member was measured, a value in a range of W=5 μm to 14 μm was illustrated. An ink containing carbon black particles having a primary particle size r (average value) of 70 nm was used as the ink. A silicon substrate was used as the nozzle plate 10.

Figure 7:
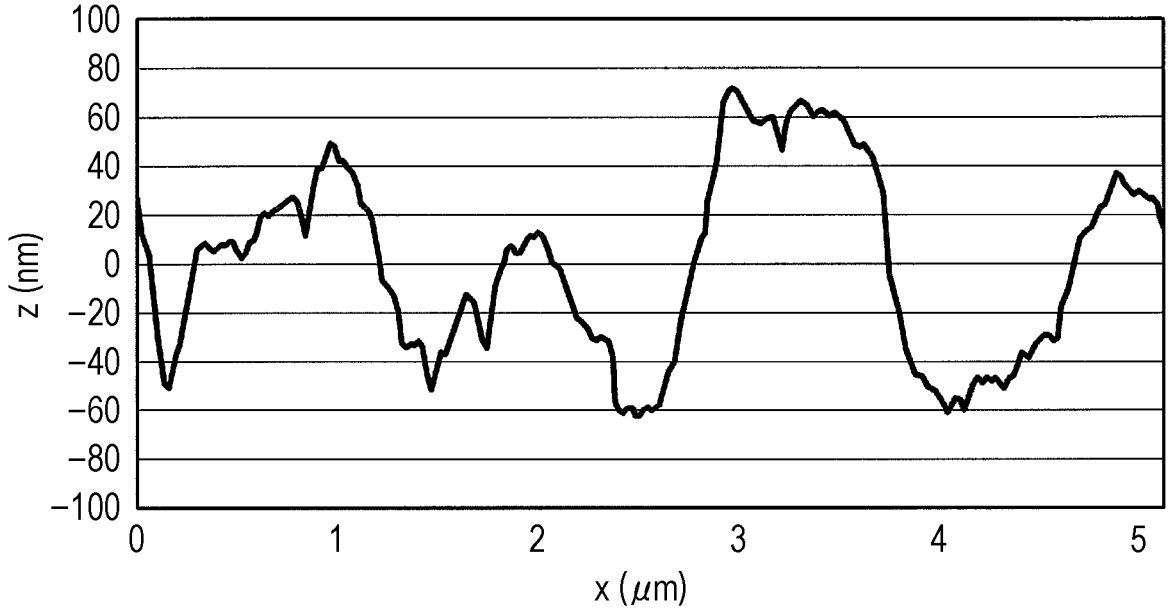
FIG. 7 is a diagram illustrating a cross-sectional profile on an ink discharge surface of a nozzle substrate for describing Example of the irregularity structure formed on the ink discharge surface.

In Example, fine protrusions and recesses (micro-roughness) having a pitch p (median value) of 970 nm and a depth d (median value) of 122 nm in the irregularity structure were formed on the ink discharge surface 10*s*. FIG. 7 is a table representing a profile of a cross-sectional shape of such Example. In the table, an x-axis direction represents a direction along the pitch p, and a z-axis direction is a direction along the depth d. A position of 70 (nm) in a z-axis is a position of the ink discharge surface 10*s* before the blasting treatment.

As a comparative example (Comparative Example 1) corresponding to the aspect of FIG. 5A, protrusions and recesses having a pitch p (median value) of 300 nm and a depth d (median value) of 43 nm in the irregularity structure were formed on the ink discharge surface 10*s*.

As another comparative example (Comparative Example 2) corresponding to the aspect of FIG. 5B, protrusions and recesses having a pitch p and a depth d (both median values) of several tens of μm in the irregularity structure were formed on the ink discharge surface 10*s*. In this Comparative Example, since the values of p and d were large and it was difficult to produce the silicon substrate by using the same blasting treatment as in Example, the silicon substrate was produced by etching.

FIG. 8 is a table representing an outline of the irregularity structure on the ink discharge surface 10*s* of each prototype (nozzle plate 10) of Example and Comparative Examples 1 and 2 described above and the results of the liquid repellency deterioration experiment. In the table, "x" indicates that the deterioration in the liquid repellency of the rubbed ink discharge surface 10*s* was recognized, and "○" indicates that the deterioration in the rubbed liquid repellency of the ink discharge surface 10*s* was not recognized. As represented in this table, according to Example having the irregularity structure satisfying both Expressions 1 and 2, it can be seen that the water-repellent film of the recess of the ink discharge surface remained and the water repellency could be maintained even when the ink containing the carbon black adhered to the ink discharge surface 10*s* was wiped.

Figure 9:
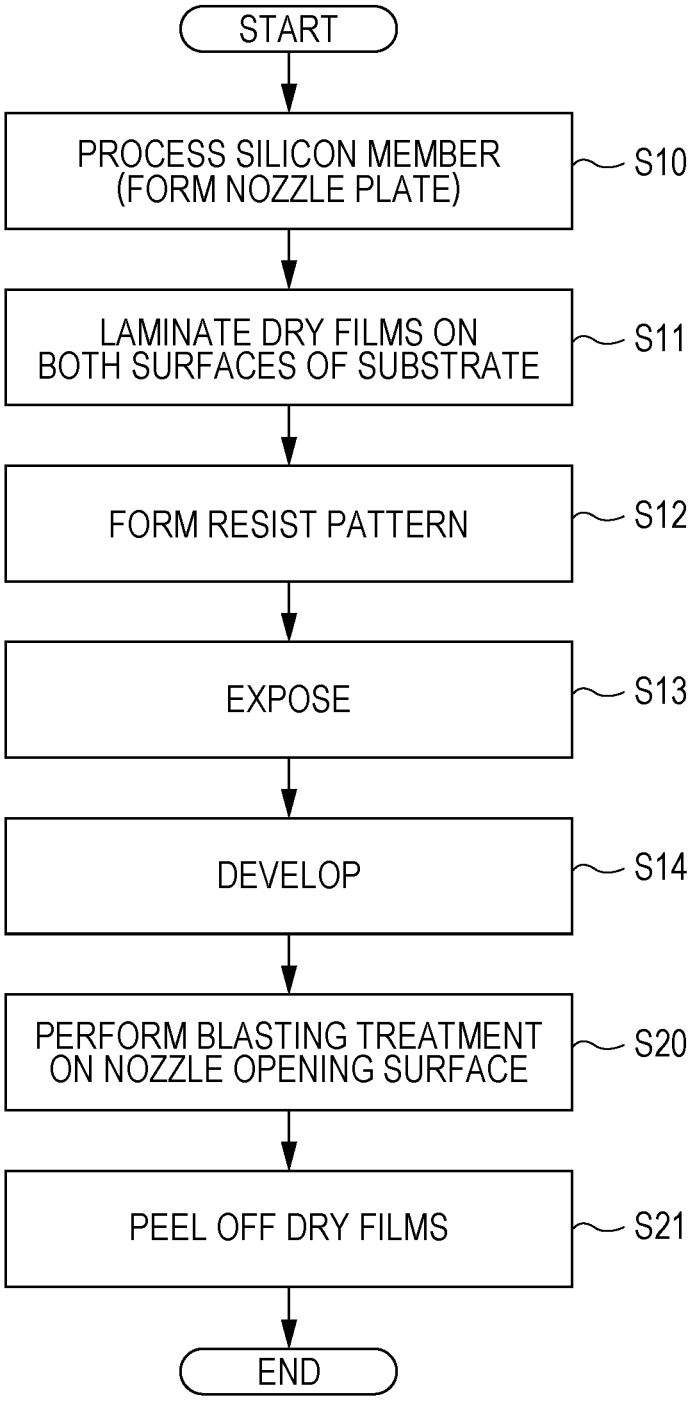
FIG. 9 is a process diagram for describing another example of the method for forming the irregularity structure on the ink discharge surface.

FIG. 9 illustrates a second method of the method for forming the irregularity structure of the ink discharge surface 10*s* in the present embodiment. In FIG. 9, the same step numbers are denoted by the same processes as those in the above-described first method. As can be seen from comparison with the first method described with reference to FIG. 6, in the second method illustrated in FIG. 9, processes of steps S11 to S14 are executed prior to the process of forming the irregularity structure by performing the blasting treatment on the nozzle opening surface (ink discharge surface 10*s*) (step S20).

Specifically, first, the silicon member is processed so as to form the nozzle holes 11 and the flow paths 12 described above in FIG. 3, and thus, the nozzle plate 10 is produced (step S10).

Subsequently, dry films are laminated on both surfaces (upper surface and lower surface in FIG. 3) of the nozzle plate 10 (step S11). This dry films play a role of not performing the blasting treatment on an originally unnecessary region at the time of the blasting treatment in step S20. Subsequently, a resist pattern is formed in a predetermined region (for example, a circular region with the nozzle hole 11 as a center) including the nozzle hole 11 of the dry film laminated on the nozzle opening surface (ink discharge surface 10*s*) (step S12). Subsequently, the region where the resist pattern is formed is removed together with the dry film by a photolithography method. Specifically, an exposure process (step S13) of causing the region where the resist pattern is formed to react by irradiating the region with light and a development process (step S14) of removing the resist of an excessive portion by immersing the exposed nozzle plate 10 in a developer are performed. Thereafter, similarly to the first method, the above-described irregularity structure is formed in the predetermined region including the nozzle holes 11 (region of the ink discharge surface 10*s* from which the dry film has been removed) by performing the blasting treatment on the ink discharge surface 10*s* (step S20). Thereafter, the excessive dry film is peeled off (step S21).

Figure 10:
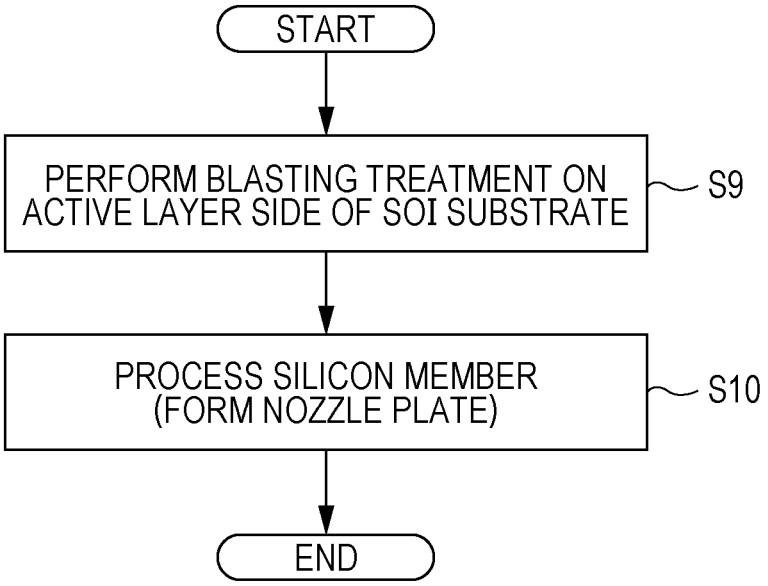
FIG. 10 is a process diagram for describing still another example of the method for forming the irregularity structure on the ink discharge surface.

FIG. 10 illustrates a third method of the method for forming the irregularity structure of the ink discharge surface 10*s* in the present embodiment. In the third method, it is assumed that a multi-layered SOI substrate is used as the material of the nozzle plate 10, and the treatment in step S9 is executed as pretreatment of step S10 (formation of the nozzle holes 11 and the flow paths 12) in the above-described first method. That is, in step S9, the above-described irregularity structure is formed in an active layer by performing the blasting treatment on the active layer side among the plurality of layers constituting the SOI substrate. Thereafter, the silicon member is processed so as to form the nozzle holes 11 and the flow paths 12 described above in FIG. 3, and thus, the nozzle plate 10 is produced (step S10). In one example, the resist pattern is formed on the SOI substrate, and the flow paths 12 and the nozzle holes 11 are formed by performing dry etching in a Deep-RIE device (not illustrated) by using a Bosch method.

Figure 11:
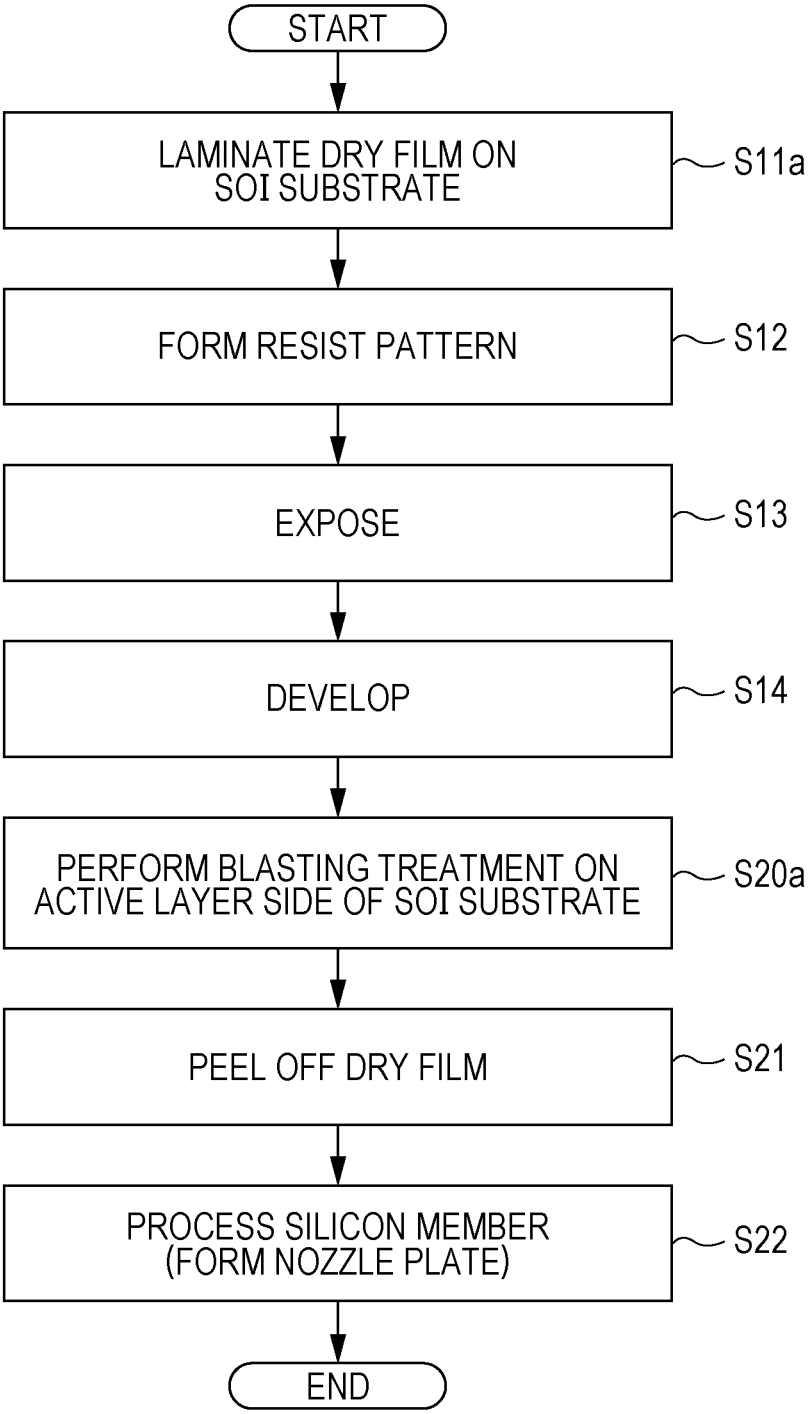
FIG. 11 is a process diagram for describing still another example of the method for forming the irregularity structure on the ink discharge surface.

FIG. 11 illustrates a fourth method of the method for forming the irregularity structure of the ink discharge surface 10*s* in the present embodiment. In FIG. 11, the same or similar step numbers are denoted by the same or similar processes as those described in FIG. 9 except for step S22. In the fourth method, it is assumed that the multi-layered SOI substrate is used as the material of the nozzle plate 10, and processes of steps S11*a* to S21 are executed as the pretreatment of step S10 (formation of the nozzle holes 11 and the flow paths 12, illustrated as step S22 in FIG. 11) in the above-described first method.

Specifically, in step S11*a*, dry films are laminated on both surfaces of the SOI substrate. Subsequently, the resist pattern is formed in a predetermined region (for example, a circular region with a portion where the nozzle hole 11 is formed as a center in step S22) of the dry film laminated on the nozzle opening surface (ink discharge surface 10*s*) (step S12). Subsequently, the region where the resist pattern is formed is removed by the above-described exposure (step S13) and development (step S14). Thereafter, similarly to the third method, the above-described irregularity structure is formed in the predetermined region (region of the ink discharge surface 10*s* from which the dry film has been removed) by performing the blasting treatment on the active layer side of the SOI substrate (step S20*a*). Subsequently, the excessive dry film is peeled off (step S21). Thereafter, the silicon member is processed so as to form the nozzle holes 11 and the flow paths 12 described above with reference to FIG. 3, and thus, the nozzle plate 10 is produced (step S22).

In the above-described embodiment, it has been assumed that the material of the wiping member is cloth, and the various methods using the blasting method (blasting treatment) have been described as a suitable method for forming the irregularity structure in this case. On the other hand, when the wiping member is made of another material (for example, rubber), the value of W may be very large as compared with the case of cloth. In such a case, the values of p and d in the irregularity structure can be increased, and the irregularity structure can be formed by using a method other than the blasting method (blasting treatment), for example, an etching treatment. Specifically, in the process of step S20 described with reference to FIG. 9, the irregularity structure can be formed by using wet etching instead of the blasting treatment.

Next, a specific example of the process after the irregularity structure is formed on the ink discharge surface 10*s* will be outlined. First, a protective film (for example, $SiO_2$ or SiC) is formed on the entire surface of the nozzle plate 10 including an inner wall of the nozzle hole 11. Subsequently, foreign substances on the front surface are removed by performing RCA cleaning on the nozzle plate 10 on which the protective film is formed.

Subsequently, a process of applying a water-repellent film to the nozzle plate 10 is executed. Specifically, first, the wettability of the front surface is improved by performing a plasma treatment on the nozzle plate 10. Subsequently, the nozzle plate 10 is dipped in a liquid obtained by diluting a water repellent agent (for example, OPTOOL) having a perfluoroalkyl group with a fluorine-based organic solvent. Thereafter, the water-repellent film is formed by causing the nozzle plate 10 to stand in a constant temperature and humidity environment, causing a chemical reaction to proceed, and forming a siloxane bond. In this state, since an unreacted component remains, a monomolecular water repellent film is formed by rinsing the nozzle plate with a fluorine-based solvent and removing an excessive compound.

In the above-described water-repellent film applying process, since the monomolecular water-repellent film is formed by dipping, the water-repellent film is formed not only on the ink discharge surface 10*s* but also on the entire surface of the nozzle plate 10 including the inner wall of the nozzle hole 11 and the like. Thus, the process of removing the water-repellent film in the excessive region is executed so as to leave the water-repellent film only on the ink discharge surface 10*s*. Specifically, the water-repellent film in the excessive region is removed by protecting the water-repellent film formed on the ink discharge surface 10*s* with a masking tape or the like and performing a plasma treatment on a rear surface.

The above-described embodiment is merely a specific example for carrying out the present invention, and the technical scope of the present invention should not be limitedly interpreted by the above-described embodiment. That is, the present invention can be implemented in various forms without departing from the gist or the main features thereof.

REFERENCE SIGNS LIST

1 inkjet head
10 nozzle plate
10*s* ink discharge surface
11 nozzle hole
200 fiber constituting wiping member
500 carbon black particle

The invention claimed is:

1. An inkjet head comprising:
a nozzle substrate including nozzle holes from which ink is discharged, wherein
the nozzle substrate has an irregularity structure formed on an ink discharge surface, and
the irregularity structure comprises a recess in which ink particles contained in the ink are accumulated and a wiping member that wipes the ink discharge surface does not get caught.

2. The inkjet head according to claim 1, wherein
the wiping member includes fibers,
at least a part of the irregularity structure is formed to satisfy following Expressions 1 and 2:

$$W \geq p \geq r \quad \text{(Expression 1); and}$$

$$d \geq r \quad \text{(Expression 2),}$$

where p is a width of a recess in the irregularity structure, d is a height of the protrusion and the recess in the irregularity structure, r is a diameter of the ink particle, and W is a width of the fiber of the wiping member.

3. The inkjet head according to claim 1, wherein
the ink particles are carbon black particles.

4. The inkjet head according to claim 1, wherein
a water-repellent base layer is provided on a front surface of the ink discharge surface.

5. The inkjet head according to claim 4, wherein
a monomolecular water-repellent film that forms a siloxane bond with the water-repellent base layer is provided on the water-repellent base layer.

6. The inkjet head according to claim 1, wherein
a material of the nozzle substrate is silicon, metal, or resin.

7. The inkjet head according to claim 3, wherein
the carbon black particles include a plurality of aggregated primary particles of carbon black.

8. An inkjet image forming apparatus comprising the inkjet head according to claim 1.

9. A nozzle plate manufacturing method, the nozzle plate being used in an inkjet head, and having nozzle holes from which ink is discharged, the method comprising:
forming, on an ink discharge surface in the nozzle plate, an irregularity structure comprising a recess in which ink particles contained in the ink are accumulated and a wiping member that wipes the ink discharge surface does not get caught.

10. The nozzle plate manufacturing method according to claim 9, wherein
the irregularity structure is formed by a blasting treatment.

11. The nozzle plate manufacturing method according to claim 9, wherein
the irregularity structure is formed by an etching treatment.

12. An inkjet head manufacturing method comprising:
forming, on an ink discharge surface in a nozzle plate, an irregularity structure comprising a recess in which ink particles contained in the ink are accumulated and a wiping member that wipes the ink discharge surface does not get caught, the nozzle plate having therein nozzle holes from which ink is discharged.

13. The inkjet head according to claim 2, wherein
the ink particles are carbon black particles.

14. The inkjet head according to claim 2, wherein
a water-repellent base layer is provided on a front surface of the ink discharge surface.

15. The inkjet head according to claim 2, wherein
a material of the nozzle substrate is silicon, metal, or resin.

16. An inkjet image forming apparatus comprising the inkjet head according to claim 2.

17. The inkjet head according to claim 3, wherein
a water-repellent base layer is provided on a front surface of the ink discharge surface.

18. The inkjet head according to claim 3, wherein
a material of the nozzle substrate is silicon, metal, or resin.

19. An inkjet image forming apparatus comprising the inkjet head according to claim 3.

20. The inkjet head according to claim 4, wherein a material of the nozzle substrate is silicon, metal, or resin.

* * * * *